United States Patent [19]

Showers

[11] Patent Number: 4,531,556

[45] Date of Patent: Jul. 30, 1985

[54] CARRIER TAPE FOR SHUTTLELESS LOOMS

[75] Inventor: Steven J. Showers, Greensboro, N.C.

[73] Assignee: Draper Corporation, Greensboro, N.C.

[21] Appl. No.: 544,501

[22] Filed: Oct. 24, 1983

[51] Int. Cl.[3] ..... D03D 47/20

[52] U.S. Cl. ..... 139/448

[58] Field of Search ..... 139/446, 447, 448

[56] References Cited

U.S. PATENT DOCUMENTS

| | | | |
|---|---|---|---|
| 3,085,598 | 4/1963 | Belforti | 139/447 |
| 3,116,761 | 1/1964 | Remington | 139/447 |
| 3,776,281 | 12/1973 | Volpe | 139/447 |

*Primary Examiner*—Henry S. Jaudon

*Attorney, Agent, or Firm*—Charles R. Rhodes; Judith E. Garmon

[57] ABSTRACT

In a carrier tape for shutttleless looms the juncture of the carrier with the tape upon which it is mounted is strengthened to resist breakage by reducing the flexing stresses in the area of the tape where the tails of the carrier are joined to the tape. The aforesaid flexing stresses are reduced by tapering the tails of the conventional carriers to a contour that provides a more gradual angular convergence with the tape, and secondly, by filling the conventional bubble in the tape with a tin alloy to stiffen the bubble area of the tape and thus move the flexing stress from the area behind the carrier to the area behind the bubble where the tape is stronger.

1 Claim, 2 Drawing Figures

CARRIER TAPE FOR SHUTTLELESS LOOMS

BACKGROUND AND SUMMARY OF PRESENT INVENTION

In the manufacture of conventional filling carriers for shuttleless looms, a carrier member is attached to a flat tape by a brazing operation. Experience has shown that a considerable number of tapes fail from fatigue in the area immediately behind the point where the carrier is attached. It is believed that the reason for such failure is because the tape has a reduced hardness in this area resulting from the brazing operation, and because the section size and stiffness drastically increases due to the attachment of the carrier at such point. The increase in stiffness causes most of the flexing in the tape to occur just behind the point where the carrier is attached in the aforesaid area of low tape hardness.

The tape is manufactured generally from an austempered AISI 1064 steel, and a "bubble" is formed in an annealed area for the purpose of strengthening such area. The carrier is then brazed with silver solder to the tape, so that tails of the carrier straddle the "bubble." Where the tape has an initial hardness in the range of 73–75.5 Rockwell A, after brazing, the tape hardness adjacent the carrier is generally in the range of Rockwell A 65, but has been measured to be as low as Rockwell A 53.

While a logical approach to improve the tape hardness in the brazed area might seem to be a quenching operation where tape is quenched with water just after brazing, such cannot be done. The reason that the quenching operation cannot be done is because the brazing alloy will crack.

Therefore, in accordance with the present invention, there has been developed a two-step approach to the solution of this problem. First of all, it was realized that there was a need to reduce the abrupt section change and rigidity at the end of the carrier, so as to reduce the flexing stresses. This was accomplished by tapering the tails of the existing carrier design to a contour having an angle beginning at the upper end that was initially steep, then flairing the taper to gradually converge with the tape surface. This results in a gradually decreasing cross-section with a smooth transition into the tape.

Secondly, to further reduce the flexing stresses at the end of the carrier, the flexing point was moved from the area immediately behind the carrier to an area behind the bubble by placing a tin alloy in the hollow chamber formed by the bubble. The tin alloy serves to stiffen the bubble, and cause flexing to take place further rearwardly in the tape.

The results of this two-step approach are surprising. Whereas, neither step alone provides significant improvement as far as fatigue life is concerned, when both steps are effected, the tape life is increased at least four to six times the normal life expectancy.

It is therefore an object of the present invention to provide an improved and strengthened filling carrier for shuttleless looms that enjoys a longer useful life.

It is another object of the present invention to provide an improved filling carrier of the type described in which the strength of the carrier is increased by reducing the flexing stresses in the weakened area of the tape which has been previously subjected to a brazing operation.

Other objects and a fuller understanding of the invention will become apparent from reading the following detailed description of a preferred embodiment along with the accompanying drawings in which:

FIG. 1 is a perspective view illustrating a typical carrier/tape assembly according to known construction; and FIG. 2 is a perspective view illustrating the modified construction according to the present invention.

DETAILED DESCRIPTION OF A PREFERRED EMBODIMENT

Figure 1:
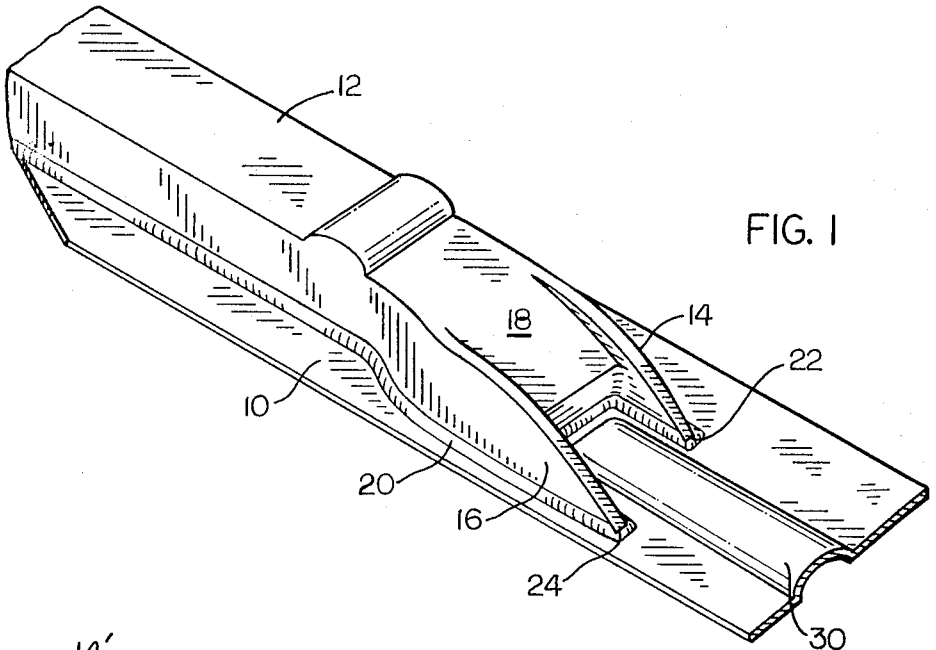

Referring now to FIG. 1, there is illustrated a typical carrier/tape assembly for shuttleless looms which is formed according to conventional techniques. The tape 10 is conventionally manufactured from an austempered AISI 1064 metallic material. A bubble 30 is formed in an annealed area of the tape for strengthening purposes. The tape is used to reciprocate the thread carrying member, otherwise referred to as the carrier 12 which is caused to enter the shed and to be withdrawn therefrom. The forward portion of the carrier 12, or the part which projects a loop of filling yarn partway through the shed is of a conventional box-like structure. This portion of the carrier forms no part of the instant invention, and therefore is not illustrated specifically herein.

The "bubble" 30 is a centrally disposed, longitudinally aligned, preformed, semi-circular raised surface which serves as a means for positioning the carrier 12 thereon. The rear end of the carrier is divided at its trailing end, forming side walls 14 and 16 which taper curve downwardly to meet the upper surface of tape 10 at points on either side of bubble 30. For a portion of their length, the side walls 14,16 are interconnected by a flat, recessed, horizontally disposed web 18, which is also slightly depressed below the upper level of side walls 14 and 16. The side walls 14 and 16 terminate at the tip ends 22, 24 where the carrier joins with the tape surface. The carrier 12 is secured to the tape by a brazing operation generally along line 20 which leads to some of the problems to be discussed hereinbelow.

As described somewhat hereinabove, the above construction has two major defects. Firstly, the side walls 14, 16 while tapered, are still relatively steep with respect to the surface of tape 10. Thus, when secured, there is an abrupt section change in the assembly at the tip ends 22,24 of the side walls 14,16 which induces certain flexing stresses in the tape at that point. Secondly, these stresses are magnified by the fact that the brazing operation tends to overheat the tape and cause softening thereof. Thus the tape material is not as strong in the area of the major flexing as in other areas.

Figure 2:
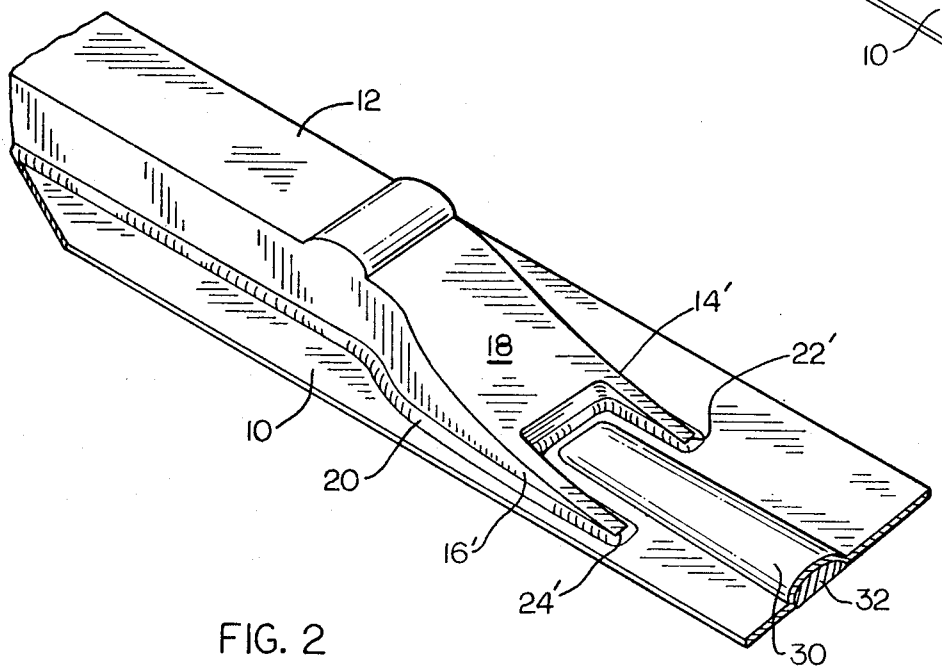

In order to overcome these problems, note the construction of FIG. 2. The tape 10 is generally of the same configuration as well as the major portion of the carrier 12. The change occurs at the rear end of carrier 12 where side walls 14', 16', are tapered considerably so that the tip ends 22',24' more gradually merge with the tape surface and the abrupt section change is eliminated. Toward this end, the side walls 14 and 16 are ground down to generally conform to the shape of the web 18. Thus, the gradually decreasing cross-section smoothly transitions or merges into the tape surface. A further change involves the moving of the flexing point from the area behind the carrier to an area behind the bubble 30. This is accomplished by placing a tin alloy material 32 in the recess of the bubble on the underneath side. This considerably stiffens the bubble, so that flexing takes place at a point further along the tape, rather than at the bubble itself.

The above use of a tin alloy 32 in the bubble may be effected in a number of ways. However, it has been found that one procedure for accomplishing the filling of the bubble 30 is according to the following steps:

1. Thoroughly clean the concave side of the bubble with a solvent such as methanol.

2. Apply fluxing agents to the cleaned surface.

3. Apply a thin coating of 50% tin, 50% lead solder to the bubble using a soldering iron.

4. Using a soldering iron, melting a tin alloy sheet material (approximately 80% tin, 14% animony, and 6% copper) into the bubble.

5. Grind the tin alloy flush with the bottom surface of the tape.

Testing of the improved design as compared with the conventional design has shown surprising results. In the Table I below, fatigue tests have been conducted on tapes returned from mills:

TABLE I

| Tape/Carrier Modification | Rockwell A Hardness[1] | Cycles To Failure |
|---|---|---|
| Normal Tape/Carrier Configuration | 65–66 | 1,530,000 |
| No Taper, Tin Alloy in Bubble | 66–69 | 729,000 |
| Taper, Tin Alloy in Bubble | 55–64 | 7,380,000 |
| Taper, Tin Alloy in Bubble | 68–71 | 8,828,000[2] |
| Taper | 60–70 | 1,171,000 |
| Taper | 69–71 | 1,688,000 |
| Taper | 57–67 | 1,345,000 |
| Double Tape, No Bubble | 69–72 | 799,000 |
| Double Tape, No Bubble | 70–74 | 329,000 |
| Extended Taper, No Bubble | 59–64 | 423,000 |

[1]Tested Behind Carrier Tails

[2]Support failed which caused tape to fail prematurely.

Unused tapes were also tested with the results summarized in Table II below:

TABLE II

| Tape/Carrier Modification | Rockwell A Hardness[1] | Cycles To Failure |
|---|---|---|
| No Taper, Tin Alloy in Bubble | 65–66 | 1,708,000 |
| Taper, Tin Alloy in Bubble | 58–64 | 6,600,000[2] |
| Taper, Tin Alloy in Bubble | 52–61 | 4,012,000[3] |

TABLE II-continued

[1]Tested behind carrier tails

[2]Not failed, test is still running

[3]Base tape failed at oscillating platten hold down support - not behind carrier All modifications were evaluated on a Universal Fatigue Testing Machine with no static load, a dynamic load of 26 pounds, an amplitude of 0.25 inches and clamped in such a manner that the carrier was secured to a stationary bed plate and the tape three and one-half inches behind the carrier was secured to an oscillating platten. The fatigue testing machine was set up in such a way that it shut off when the tape broke.

The tape hardness at a point immediately behind the carrier and the number of cycles to failure are listed in Tables I and II. All samples failed in substantially the same location (behind the carrier), which was to be expected as this is the point at which tapes conventionally fail in mills. The one tape (sample #4) that survived 8,828,000 failed because the testing machine support failed, which in turn caused the tape to fail. This tape could have possibly survived many more cycles if the support had not failed. The tape itself, prior to the time any carrier is secured thereto, has been tested to be able to survive 10,000,000 cycles. The incorporation of the invention may eventually show that the brazing of the carrier in the manner described hereinabove does not materially alter that expected life.

The testing shows that tapering the tails or filling the bubble alone does not increase the fatigue life. However, both tapering the tails and filling the bubble have considerably increased the fatigue life of the tape on the order of five times.

While a preferred embodiment of the invention is described in detail hereinabove, it is apparent that various changes and modifications might be made to the invention without departing from the scope thereof which is set forth in the accompanying claims.

What is claimed is:

1. Improvements in the construction of carrier tapes for shuttleless looms of the type in which a weft yarn from a source of supply is inserted by opposed flexible carrier tapes within sheds formed by warp threads, in which the trailing end tails of the carriers are attached to the tape by brazing on either side of a central raised surface or bubble on the tape, said improvement comprising:

(a) said end tails being of a shape tapering from top to bottom in such a manner that the angle of taper is greater near the top and gradually decreases providing a smooth transition of said end tails into said tape so as to reduce flexing stresses therein; and (b) a metallic filler means heat fused in the underside of said bubble so as to substantially fill and conform to the shape of said bubble, whereby the point of tape flexing is moved to a section of tape that has not been weakened by brazing.

* * * * *